US007450880B1

(12) United States Patent
Estabrooks et al.

(10) Patent No.: US 7,450,880 B1
(45) Date of Patent: Nov. 11, 2008

(54) WASTE TONER RECYCLING

(75) Inventors: Dennis Charles Estabrooks, Boulder, CO (US); Eric William Jepsen, Longmont, CO (US)

(73) Assignee: Anew Green, Inc

( * ) Notice: Subject to any disclaimer, the term of this patent is extended or adjusted under 35 U.S.C. 154(b) by 199 days.

(21) Appl. No.: 11/419,883

(22) Filed: May 23, 2006

Related U.S. Application Data

(63) Continuation-in-part of application No. 11/277,010, filed on Mar. 20, 2006, now abandoned.

(51) Int. Cl.
*G03G 21/00* (2006.01)
*G03G 21/10* (2006.01)

(52) U.S. Cl. ..... 399/109; 399/358

(58) Field of Classification Search ..... 399/109, 399/358, 359, 24, 27
See application file for complete search history.

(56) References Cited

U.S. PATENT DOCUMENTS

| | | | | |
|---|---|---|---|---|
| 2,536,300 | A | | 1/1951 | Martin |
| 2,778,387 | A | | 1/1957 | Diehl |
| 3,191,642 | A | | 6/1965 | Saito |
| 3,304,127 | A | | 2/1967 | Huffaker |
| 3,305,133 | A | | 2/1967 | Parker |
| 3,942,561 | A | | 3/1976 | Stoeffler |
| 4,054,381 | A | | 10/1977 | Bernard |
| 4,185,669 | A | | 1/1980 | Jevakohoff |
| 4,561,759 | A | | 12/1985 | Knott |
| 4,715,748 | A | | 12/1987 | Krambrock |
| 5,200,788 | A | | 4/1993 | Thayer |
| 5,381,217 | A | | 1/1995 | Ishida |
| 5,521,690 | A | * | 5/1996 | Taffler et al. ..... 399/93 |
| 5,532,800 | A | | 7/1996 | Saito |
| 5,727,607 | A | | 3/1998 | Ichikawa et al. |
| 5,729,804 | A | | 3/1998 | Aruga et al. |
| 5,888,691 | A | | 3/1999 | Laing et al. |
| 5,937,235 | A | | 8/1999 | Huss et al. |
| 5,987,298 | A | | 11/1999 | Muramatsu et al. |
| 6,108,511 | A | * | 8/2000 | Kutsuwada et al. ..... 399/359 |
| 6,112,046 | A | | 8/2000 | Suzuki et al. |

(Continued)

FOREIGN PATENT DOCUMENTS

| | | |
|---|---|---|
| WO | WO2004012866 | 2/2004 |

OTHER PUBLICATIONS

International Search Report from corresponding PCT application dated Apr. 5, 2007.

*Primary Examiner*—Sophia S Chen
(74) *Attorney, Agent, or Firm*—Margaret Polson; Patent Law Offices of Rick Martin

(57) ABSTRACT

A method for cleaning waste toner from an image forming apparatus is provided wherein the toner can be cleaned externally, repackaged and returned to the image forming apparatus like new. The toner is removed from the image forming device by means of normal waste containers. In a separate location apart from the image forming apparatus, the toner waste is removed by vacuum and passed through various cleaning stages to remove non toner products. The toner is passed directly to a toner filling device which is used to repackage the toner into original toner containers. This method reduces total cost of toner supplies since waste toner can be reclaimed. Also the method allows for a cleaner environment since the toner and packaging waste is not sent to landfills.

19 Claims, 4 Drawing Sheets

U.S. PATENT DOCUMENTS

| | | | | |
|---|---|---|---|---|
| 6,113,681 | A | 9/2000 | Tripathi et al. | |
| 6,497,259 | B1 | 12/2002 | Wegman | |
| 6,542,176 | B1 | 4/2003 | Camis | |
| 6,863,096 | B2 | 3/2005 | Amano | |
| 7,017,625 | B2 | 3/2006 | Amano et al. | |
| 7,252,250 | B2 * | 8/2007 | Morriss et al. | 241/19 |
| 2002/0064400 | A1 | 5/2002 | Vandewinckel et al. | |
| 2004/0005167 | A1 * | 1/2004 | Morii et al. | 399/109 |
| 2004/0005508 | A1 | 1/2004 | Kimura et al. | |
| 2005/0002709 | A1 | 1/2005 | Jeong et al. | |
| 2006/0000309 | A1 | 1/2006 | Morii et al. | |
| 2006/0024102 | A1 | 2/2006 | Jung | |
| 2006/0088352 | A1 * | 4/2006 | Isokawa et al. | 399/359 |
| 2006/0216632 | A1 | 9/2006 | Berko-Boateng et al. | |

* cited by examiner

WASTE TONER RECYCLING

RELATED PATENT APPLICATIONS

This application is continuation in part application of application Ser. No. 11/277,010 filed Mar. 20, 2006.

FIELD OF THE INVENTION

The present invention relates to recycling and/or reprocessing waste toner from image forming processes.

BACKGROUND

In the image forming process most of the toner is transferred to the print media, usually paper. Waste toner is the leftover toner that did not transfer to the media and is cleaned from the image forming stage by various methods. All debris removed during this cleaning stage are put back into the internal toner supply within the image forming apparatus or is passed into a waste container. The waste container and/or internal toner supply is removed from the image forming apparatus after a certain image count has been reached or the container is measured as full. The container is then discarded and replaced with an empty container. Even if the internal toner supply cartridge is recycled, the waste toner itself is not.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

The present invention supplements or replaces prior art internal image apparatus methodologies and eliminates sending waste toner bottles and waste toner to landfills. The present invention proposes a method by which the toner can be cleaned externally from the image forming apparatus. Cleaning waste toner outside of the image forming device has many advantages since waste bottles can contain large amounts of debris and are usually very dirty and difficult to handle. This also allows large amounts of waste toner to be recycled at one time, as opposed to small batch processing in a single machine.

In addition to the exemplary aspects and embodiments described above, further aspects and embodiments will become apparent by reference to the accompanying drawings forming a part of this specification wherein like reference characters designate corresponding parts in the several views.

DETAILED DESCRIPTION OF THE DRAWINGS

Figure 1:
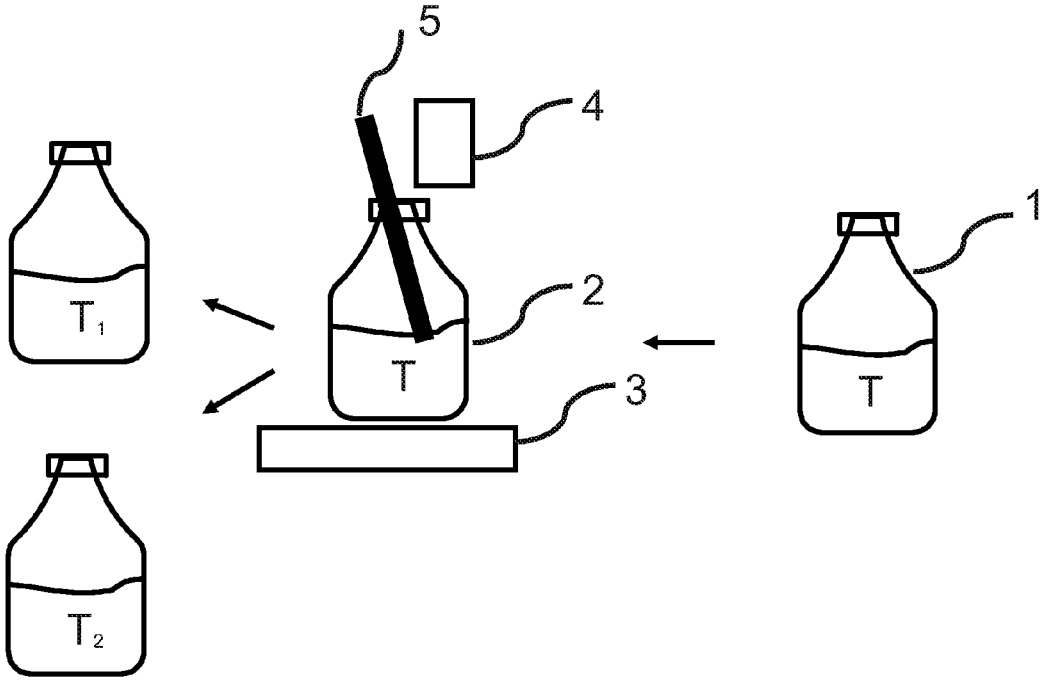
FIG. 1 is a schematic drawing of the toner separation process.

Referring first to FIG. 1, the present process can process waste toner T from various containers and various toner types. The first major phase in processing the waste toner is to determine the type of toner T in waste toner bottle 1 since waste toner bottles 1 can have color toner, black toner (mono or dual component), Magnetic Ink Character Recognition (MICR) toner or any other toner type. Different toners T have different types and levels of metal particles and so react differently to magnetic fields. A stationary metal detector 3, and or handheld metal detector 4 can be used to help distinguish the toner type. For example, MICR toner consists of metal particles and produces a measurable signal from the detectors. The ratio of the signal strength to weight of the toner material is used to determine whether a waste toner bottle is MICR or other toner with a small portion of metal in the bottle. A handheld magnet 5 can also be placed in the bottle 2 to give a second verification of the waste toner content since MICR toner, metal beads and different type of toners adhere differently to the magnet. The visual inspection on how the toner adheres to the magnet combined with the signal strength of the metal detector is used to determine and separate toner types $T_1$ and $T_2$.

Figure 2:
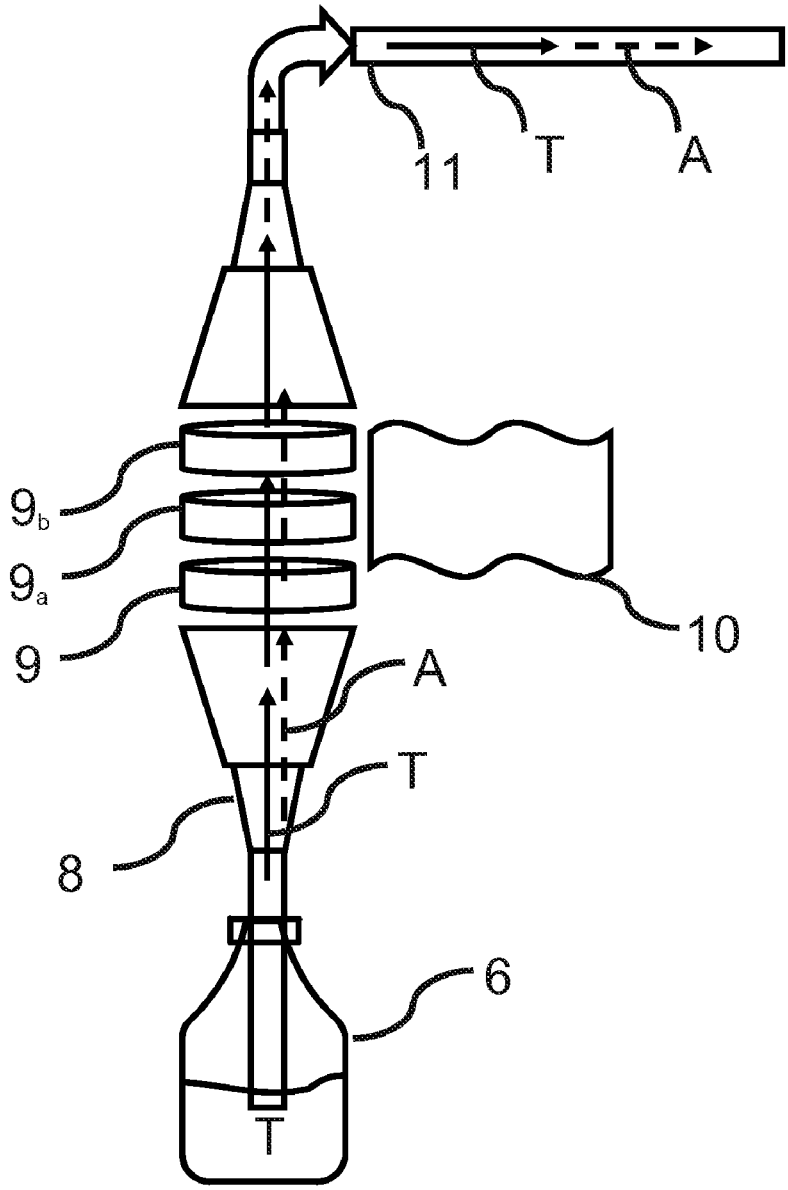
FIG. 2 is a schematic drawing of the first stage of the recycling process.

As seen in FIG. 2, after the waste toner T is separated by toner type it is moved by air. A flow out of bottle 6 through a diverging funnel 8 which allows the toner T to become airborne and thus separated from neighboring toner particles. In an alternate embodiment (not shown) the waste toner T can be contained in and removed from large holding containers such as barrels. The air flow can be created by vacuum pumps, blowers or other known methods. The flow path of toner T is indicated by solid arrows, the flow path of air A is indicated by broken arrows. Both air A and toner T is passed through at least one fine mesh screen 9 that removes debris from the toner. The first screen 9 is used to separate large debris. If more than one screen 9 is used, each following screen 9 has a smaller mesh size that is used to stop smaller and smaller contaminates from continuing.

Different toner types require different screen configurations. For example, one toner may require only two screens 9 and another toner requires three screens. The initial mesh size is generally about 1.0 mm in the first screen 9 and reduces to about 0.75 mm in the second screen 9*a* for most MICR toners and reduces to about 0.5 mm in the third screen 9*b* for most standard toners. If a cleaning system that is designed to clean multiple type of toner is being used, screens 9 are removable, and the correct screens for the type of toner to be cleaned would be put in place. If dedicated cleaning devices are in use, each type of machine would have a given set of screens.

Figure 3:
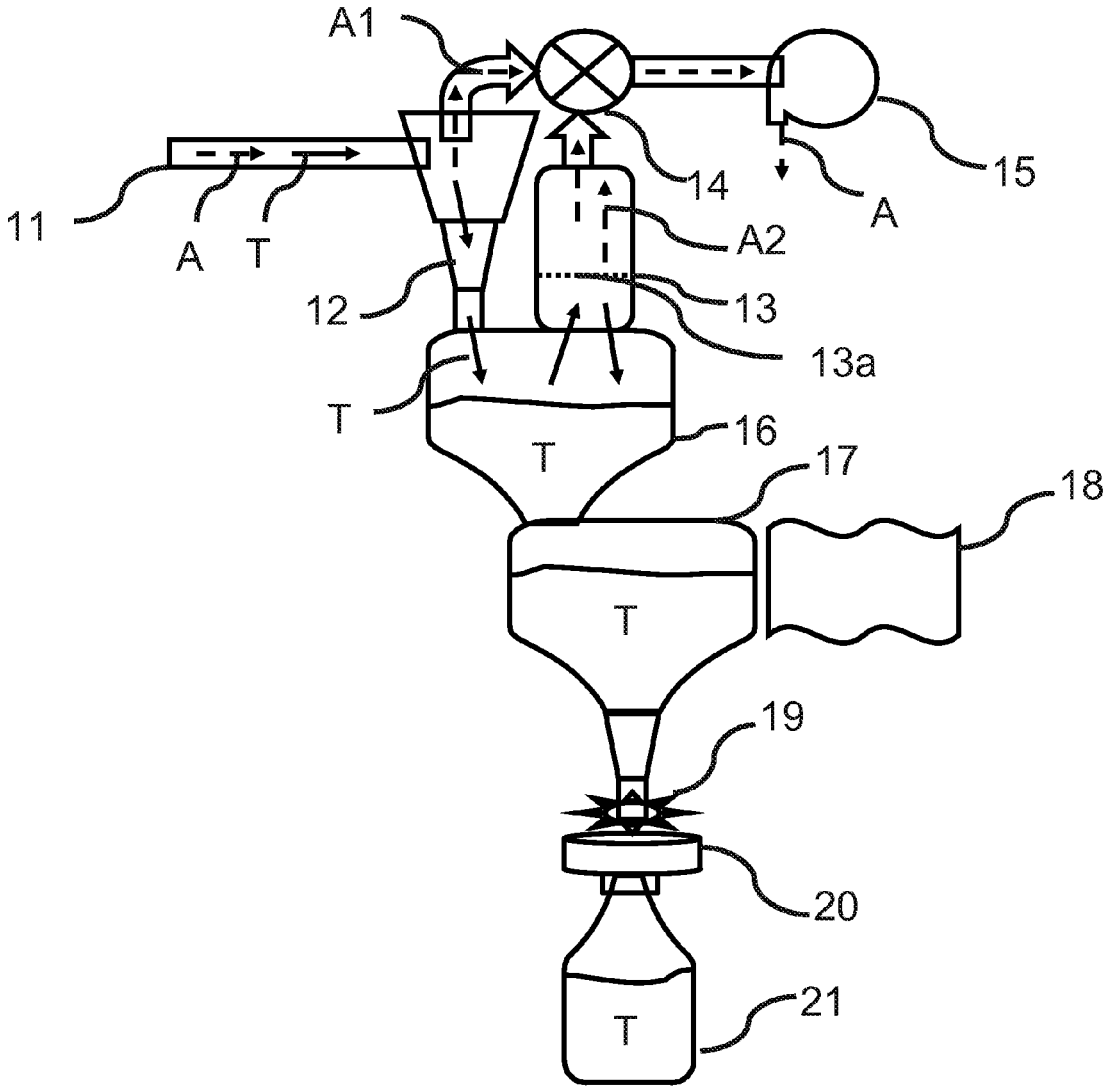
FIG. 3 is a schematic drawing of the final stages of the recycling process.

Also, depending on the toner type, the mesh screens can be vibrated mechanically or acoustically 10 to keep the airborne toner from adhering to the screens. Typically, toners with poor flow qualities, example MICR, require mechanical vibration 10. Toners with excellent flow characteristics do not require vibration 10. Each toner type has different flow characteristics so the decision to use vibration 10 is determined by how much the air flow is required to pull the toner T through the screens 9. Also is the condition of screens 9 is monitored by the air flow through the screens 9. If the air flow decreases to a set amount the operator removes the screens 9 and cleans the collected debris by vacuum or air pressure. After the toner has passed through the screening process it is continued to be pulled by air flow A through pipe 11 to the next stage Referring next to FIG. 3, the airborne toner T must be separated from the air A. Two different separation devices, a cyclone 12 or a pulse filter 13 can be used to separate the toner T from the air flow A. In non dedicated systems the operator chose which device to use depending on the weight of the toner T. The cyclone 12 is used for lighter weight toner particles since it has high separation efficiency. On heavier weight toner types the toner T is separated by a pulse filter 13. The operator can control which air separation device is by valve 14 which is connected to an air flow system 15, a vacuum system in the depicted example.

The toner T and airflow are directed into a cyclone 12 from pipe 11. If the operator wishes to use the cyclone 12 as the separator, air flow $A_1$ is turned on using valve 14 causing the cyclone 12 to function in a know manner to pull the air out and force the toner into the toner hopper 16.

If the operator wishes to use the pulse filter 13 then valve 14 is turned to the other setting, causing air flow $A_2$. The filter 13*a* allows the air A, not toner T, to pass through filter 13*a*. The pulse filter 13 applies a positive pressure pulse periodically to dislodge the adhered toner from filter 13. The same pulse method is used to periodically clean filters 9 as seen in FIG. 1.

Once the toner T is separated from the air transport system the toner T falls into the bottom of toner hopper 16. The toner hopper 16 provides a holding area for incoming toner T until needed by the toner filler 17. As the toner T passes through the toner filler 17 a magnet 18 can be applied to the toner T to remove any metal beads that have not been removed so far. The magnet 18 can be either placed inside or outside the toner filler 17.

The toner T is dispensed through two final cleaning stages. Toner T flows over a series of stationary metal rods 19 before leaving the toner filler 17 which attracts any fibers that have not been cleaned in previous stages. The fibers are attracted to the metal rods since the fibers have a built up a static charge due to the kinetic flow of toner T through the toner filler 17. Fiber debris are periodically removed from the rods by the operator. After the toner T passes the metal rods 19 it is passed through a final mesh screen 20, typically about 1.0 mm, to catch any remaining contaminants.

Once the cleaning process is complete the clean toner is refilled into containers 21. This cleaned toner T can be returned in the original or new toner packaging. For most toner types the toner is placed back into the original packaging to reduce waste and allow the customer to maintain ownership of the bottles. This toner can now be returned to the customer and used in the original image forming apparatus or sold to new users.

Figure 4:
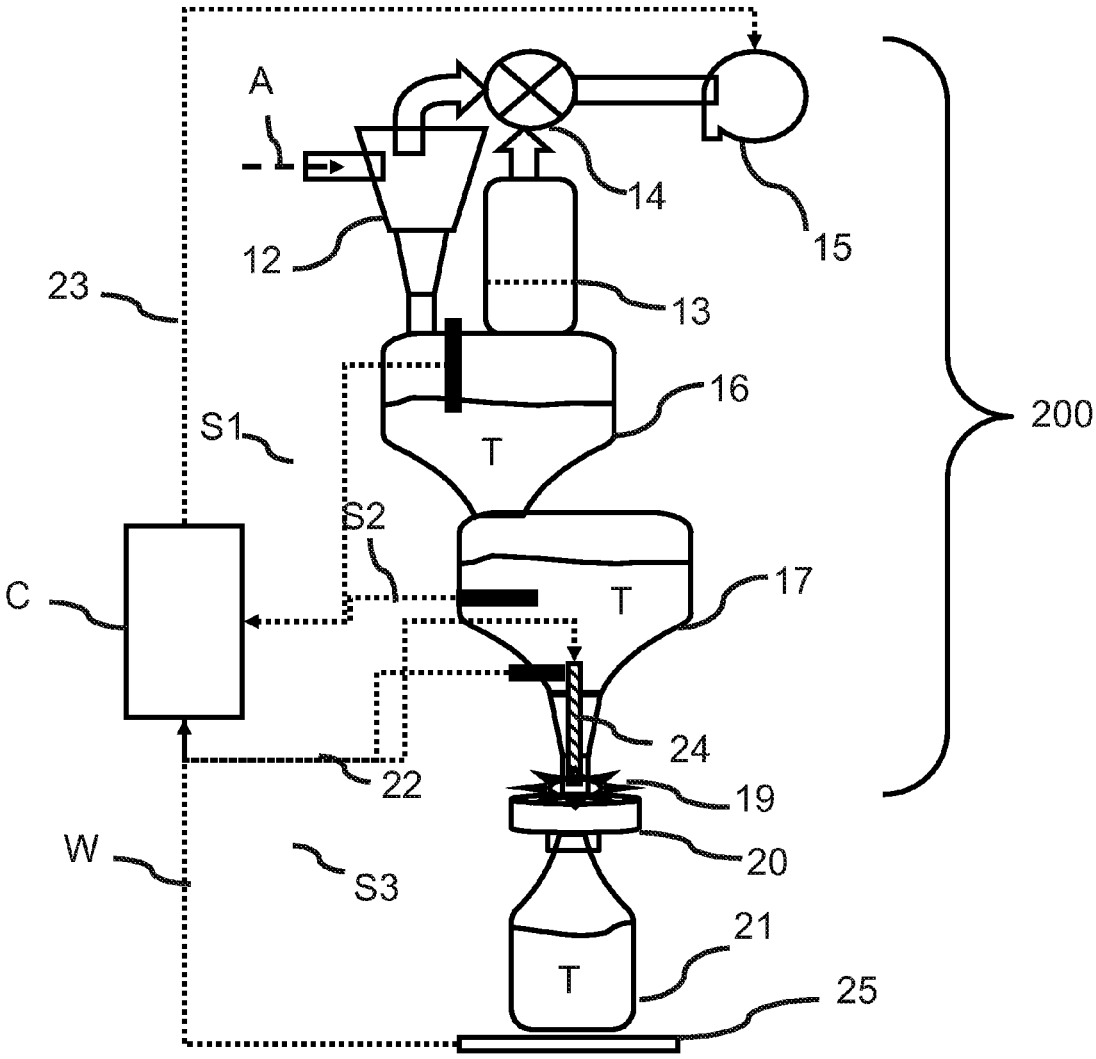
FIG. 4 is a schematic drawing of the automation steps of the recycling device Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

Referring next to FIG. 4, in an automated system 200 the air flow A provided by the vacuum motor 15 is controlled by several sensors. The first sensor S1 detects the level of toner T in the toner hopper 16. When the sensor S1 detects a full state in the toner hopper 16 it sends a signal to the control box C and the vacuum motor is switched off by control signal line 23. All electrical signal lines in FIG. 4 are represented as dashed lines. This stops the flow of toner T and air A through pipe 11. The vacuum motor 15 is switched on again when sensor S2 in the filler hopper 17 detects a toner T low condition. The vacuum motor 15 switches on and off by the conditions of sensor S1 and S2. In an alternate embodiment (not shown), the air flow could be provide by one or more blowers in the system or a combination of blowers and vacuum pumps.

The device can be operated in a manual override mode in the event there are contradictory signals from S1 and S2, possibly caused sensor failure or lack of toner flow or other problems.

As toner T fluctuates between toner full and empty conditions in toner hopper 16 and toner filler 17 toner T is filled into bottle 21 by toner auger 24. The toner auger 24 is controlled by signal 22 from the control box C. The control box C can control the auger 24 by the weight signal W of toner bottle 21 from scale 25 or by counting the revolutions of the toner auger 24 by signal S3.

As represented in FIG. 4, the control scheme of this device 200 allows the operator to continuously fill toner T without having to stop and manually switch the vacuum device on and off as toner is needed. In this embodiment the device can turn on the vacuum motor 15 when toner is needed and stop when it is full. The control system can continue to monitor the toner T levels within the device by using sensors S1 and S2 so the operator only has to focus on placing bottles under the filling hopper 17 and activating the auger 24 by pressing a start button. The toner weight W or number of auger revolutions is set by operator inputs on the front of the control box C. Once the control box C reaches the operator it stops the auger 24 and allows the operator to remove the full container and replace it with an empty container. Theoretically the toner filling device 200 can run without stopping as long as the supply of toner T in hopper 16 is endless and the bottles are filled and replaced as needed.

In an alternate embodiment (not shown), the placement of the bottles to be filled and removal of full bottles could be completely automated using known assembly line technology.

The present invention reduces the cost of purchasing new toner since the waste toner can be reclaimed. This toner is returned to consumers at a reduced price since the product is not new or sold as recycled at a lower price than new toner. When the cleaned toner is returned to the original user the overall cost of supplies is reduced. The method allows a new service for toner using customers by allowing them to recycle their toner and thereby reduce overhead. The business model includes that each customer will go through a certification process to save waste toner and ensure different toners are not mixed. Additionally, customers can either have the waste toner processed on-site or schedule a pickup and the delivery of the reclaimed toner is provided to ensure, if needed, the customer maintains ownership during the processing.

Additionally, waste toner drop off locations can be maintained for small businesses that do not wish to have a long term contract, but do wish to recycle. This toner can be sold to either existing recycling customers to provide a replacement for the toner actually consumed in the image making process or on the open market.

The present invention also reduces the waste, other than toner, from the image forming apparatus and therefore waste going into landfills. Typical waste from an image forming device is: toner, waste container and new toner packaging. All of which are comprised of some form of cardboard, plastic and metal. This material can also be reused by the consumer since the toner is reused, the waste container is emptied and the previously new toner packaging is refilled. All of this material remains in use by the consumer and is not sent to landfills.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

We claim:

1. A method of cleaning waste toner from an image forming apparatus comprising the steps of;

removing a batch of waste toner contaminated with debris from the image forming apparatus;

transporting the contaminated waste toner to a distant location separate from the image forming apparatus;

combining the batch of contaminated waste toner with an air flow;

separating contaminants from the airborne toner by passing the air and toner flow through at least one mesh screen;

vibrating the at least one mesh screen to remove adhering toner;

after the toner has passed through the mesh screen, further passing the toner over a device to attract highly charged fiber debris while lower charge toner is not sufficiently attracted;

collecting the toner in a container for reuse.

2. The method of claim 1 further comprising, using a metal detection system to determine and separate toner types with varying levels of metallic particles when the source of the toner is unknown.

3. The method of claim 2 further comprising combining toner of the same type from multiple sources into a single batch.

4. The method of claim 1 further comprising the step of using an air separation device to remove the toner from the air flow rapidly.

5. The method of claim 4 wherein the air separation device is selected from a cyclone or pulse filter.

6. The method of claim 5 further comprising the steps of periodically providing a positive pressure pulse to the pulse filter to dislodge toner from the pulse filter.

7. The method of claim 1 further comprising the step of periodically vibrating the at least one mesh screen to remove adhering toner.

8. The method of claim 1 further comprising the steps of passing the contaminated toner near a magnet before passing it over the device to attract highly charged fibers.

9. The method of claim 8 further comprising the step of passing the toner through an additional mesh screen after the device to attract highly charged fibers.

10. A method of recovering unused toner comprising the steps of:

picking up waste toner contaminated with debris from at least one given location after the waste toner has been removed from an image forming apparatus;

separating the toner picked up by type of toner;

choosing a method of removing debris specific for each toner type;

repackaging recovered unused toner and shipping the recovered unused toner back to the given location.

11. A method of processing toner comprising the steps of:

collecting waste toner contaminated with debris from at least one given location;

separating the toner picked up by type of toner;

choosing a method removing debris specific for each toner type;

and repackaging cleaned recovered unused toner to be sold.

12. A device for cleaning toner that has been removed from an image forming apparatus of debris comprising:

a first bin to hold a given batch of toner;

a conduit to carry the toner from the first bin;

a device to produce an air flow in said conduit and said air flow being combined with the toner;

at least one mesh screen mounted in the air flow to sized to catch debris of the given batch of toner;

a second bin to hold the filtered toner;

a device to attract highly charged fiber debris, while lower charge toner passes, mounted at the bottom of the second bin;

a device for dispensing the toner from the second bin into a container for reuse.

13. The device of claim 12 further comprising a metal detection system to determine and separate different toner types with varying levels of metallic particles.

14. The device of claim 12 further comprising an air separation device to remove the toner from the air flow rapidly.

15. The device of claim 14 wherein the air separation device is selected from a cyclone or pulse filter.

16. The device of claim 12 further comprising two air separation devices mounted on the device such that an operator can select from one of said air separation devices, depending on the type of toner being cleaned.

17. The device of claim 12 further comprising a means to periodically vibrate the at least one mesh screen to remove adhering toner.

18. The device of claim 12 further comprising a magnet, to attract any metal developer debris, mounted on the second bin.

19. The device of claim 12 further comprising an additional mesh screen for passing the toner through after the device to attract charged fibers.

* * * * *